US009042751B2

(12) United States Patent
Okada

(10) Patent No.: US 9,042,751 B2
(45) Date of Patent: May 26, 2015

(54) HIGH VOLTAGE POWER SUPPLY AND IMAGE FORMING APPARATUS

(71) Applicant: KYOCERA Document Solutions Inc., Osaka-shi, Osaka (JP)

(72) Inventor: Masanori Okada, Osaka (JP)

(73) Assignee: KYOCERA Document Solutions Inc. (JP)

( * ) Notice: Subject to any disclaimer, the term of this patent is extended or adjusted under 35 U.S.C. 154(b) by 56 days.

(21) Appl. No.: 13/904,322

(22) Filed: May 29, 2013

(65) Prior Publication Data

US 2013/0322899 A1 Dec. 5, 2013

(30) Foreign Application Priority Data

May 30, 2012 (JP) ..... 2012-122873

(51) Int. Cl.
*G03G 15/00* (2006.01)
*G03G 15/06* (2006.01)

(52) U.S. Cl.
CPC ..... *G03G 15/065* (2013.01); *G03G 15/5037* (2013.01); *G03G 15/5045* (2013.01); *G03G 2215/00772* (2013.01)

(58) Field of Classification Search
CPC ..... G03G 15/5058; G03G 15/065; G03G 2215/00059; G03G 15/0131; G03G 15/55; G03G 15/5062; G03G 2215/0164; G03G 15/0178; G03G 15/0194; G03G 15/0266; G03G 15/0808; G03G 15/0818
USPC ..... 399/44, 98, 27, 30, 88
See application file for complete search history.

(56) References Cited

U.S. PATENT DOCUMENTS

| | | | | |
|---|---|---|---|---|
| 2001/0033755 | A1 | 10/2001 | Ino et al. | |
| 2002/0057918 | A1* | 5/2002 | Kojima et al. | 399/27 |
| 2006/0269306 | A1* | 11/2006 | Shimizu | 399/44 |
| 2010/0129102 | A1* | 5/2010 | Fujihara et al. | 399/55 |
| 2010/0239286 | A1 | 9/2010 | Hanashi | |

FOREIGN PATENT DOCUMENTS

| | | |
|---|---|---|
| JP | 9-197781 | 7/1997 |
| JP | 2011085710 | 4/2011 |

* cited by examiner

*Primary Examiner* — Roy Y Yi
(74) *Attorney, Agent, or Firm* — Gerald E. Hespos; Michael J. Porco; Matthew T. Hespos

(57) ABSTRACT

A high voltage power supply includes a developer carrier, an image carrier, a developing control unit, a load detection unit, a variation detection unit, and a voltage correction unit. The developing control unit applies a developing bias voltage to the developer carrier and thereby supplies the developer to the image carrier and develops an electrostatic latent image. The variation detection unit detects the variation in capacitance between the developer carrier and the image carrier detected by the load detection unit. The voltage correction unit corrects the developing bias voltage by decreasing the developing bias voltage as the variation increases, and increasing the developing bias voltage as the variation decreases.

10 Claims, 5 Drawing Sheets

HIGH VOLTAGE POWER SUPPLY AND IMAGE FORMING APPARATUS

INCORPORATION BY REFERENCE

This application relates to and claims priority from Japanese Patent Application No. 2012-122873, filed on May 30, 2012 in the Japan Patent Office, the entire disclosure of which is incorporated herein by reference.

BACKGROUND

The present disclosure relates to a high voltage power supply and an image forming apparatus, and in particular to technology for correcting a developing bias voltage.

Conventionally, known is technology for reducing the deterioration of image quality by maintaining a constant level of intensity of an electric field that is generated between a photoreceptor (image carrier) and a developing roller (developer carrier) as a result of applying, to the developing roller, a developing bias voltage that is obtained by superimposing a direct voltage and an alternating voltage, and thereby developing an electrostatic latent image. The foregoing direct voltage and alternating voltage are optimized, for example, according to the magnetic intensity of the developer (toner), and the photosensitive material (for instance, amorphous silicon) forming the photoreceptor surface.

Even when an optimized developing bias voltage is applied, if the distance between the photoreceptor and the developing roller changes due to some cause such as the eccentricity of the photoreceptor during development, the intensity of the electric field generated between the photoreceptor and the developing roller will consequently change. As a result, there is a possibility that excess or deficiency will arise in the amount of developer to be supplied to the photoreceptor. Thus, there is one conventional technology for correcting the developing bias voltage. With this conventional technology, capacitance between the photoreceptor and the developing roller is detected, which indicates the distance between the photoreceptor and the developing roller. In addition, the developing bias voltage is corrected to become a proper value that is associated with an absolute value of the magnitude of the detected capacitance. The proper value is set in advance by being associated with the absolute value of the magnitude of the capacitance based on an experimental value obtained from a test operation and the like.

Nevertheless, the capacitance between the photoreceptor and the developing roller changes not only based on the distance between the photoreceptor and the developing roller, but changes also based on environmental conditions such as the humidity and atmospheric pressure between the photoreceptor and the developing roller. Accordingly, upon correcting the developing bias voltage to become the proper value that is associated with the detected capacitance, there is a possibility that the detected capacitance includes the capacitance that changed due to environmental conditions. In the foregoing case, there is a possibility that the developing bias voltage cannot be appropriately corrected since the distance between the photoreceptor and the developing roller is erroneously determined.

For instance, there is a possibility that the developing bias voltage is corrected more than needed as a result of attempting to move the developer in a distance that is longer than the actual distance between the photoreceptor and the developing roller. Contrarily, there is a possibility that the developing bias voltage is corrected less than needed as a result of attempting to move the developer in a distance that is shorter than the actual distance between the photoreceptor and the developing roller. As a result of the above, there is a possibility that excess or deficiency will arise in the amount of developer to be supplied to the photoreceptor, which in turn will cause the deterioration in the image quality of toner images formed on the photoreceptor.

An object of the present disclosure is to appropriately correct the developing bias voltage for reducing the deterioration in the image quality of toner images formed on the photoreceptor.

SUMMARY

The high voltage power supply according to one aspect of the present disclosure includes a developer carrier, an image carrier, a developing control unit, a load detection unit, a variation detection unit, and a voltage correction unit. The developer carrier carries a developer on a peripheral surface thereof. The image carrier carries an electrostatic latent image on a peripheral surface thereof. The developing control unit applies a developing bias voltage, which is obtained by superimposing a direct voltage and an alternating voltage, to the developer carrier and generates a potential difference between the developer carrier and the image carrier, and thereby supplies the developer to the image carrier and develops the electrostatic latent image. The load detection unit detects capacitance between the developer carrier and the image carrier. The variation detection unit detects a variation in the capacitance detected by the load detection unit. The voltage correction unit executes correction processing of correcting the developing bias voltage by decreasing the developing bias voltage as the variation increases, and increasing the developing bias voltage as the variation decreases.

DETAILED DESCRIPTION

Figure 1:
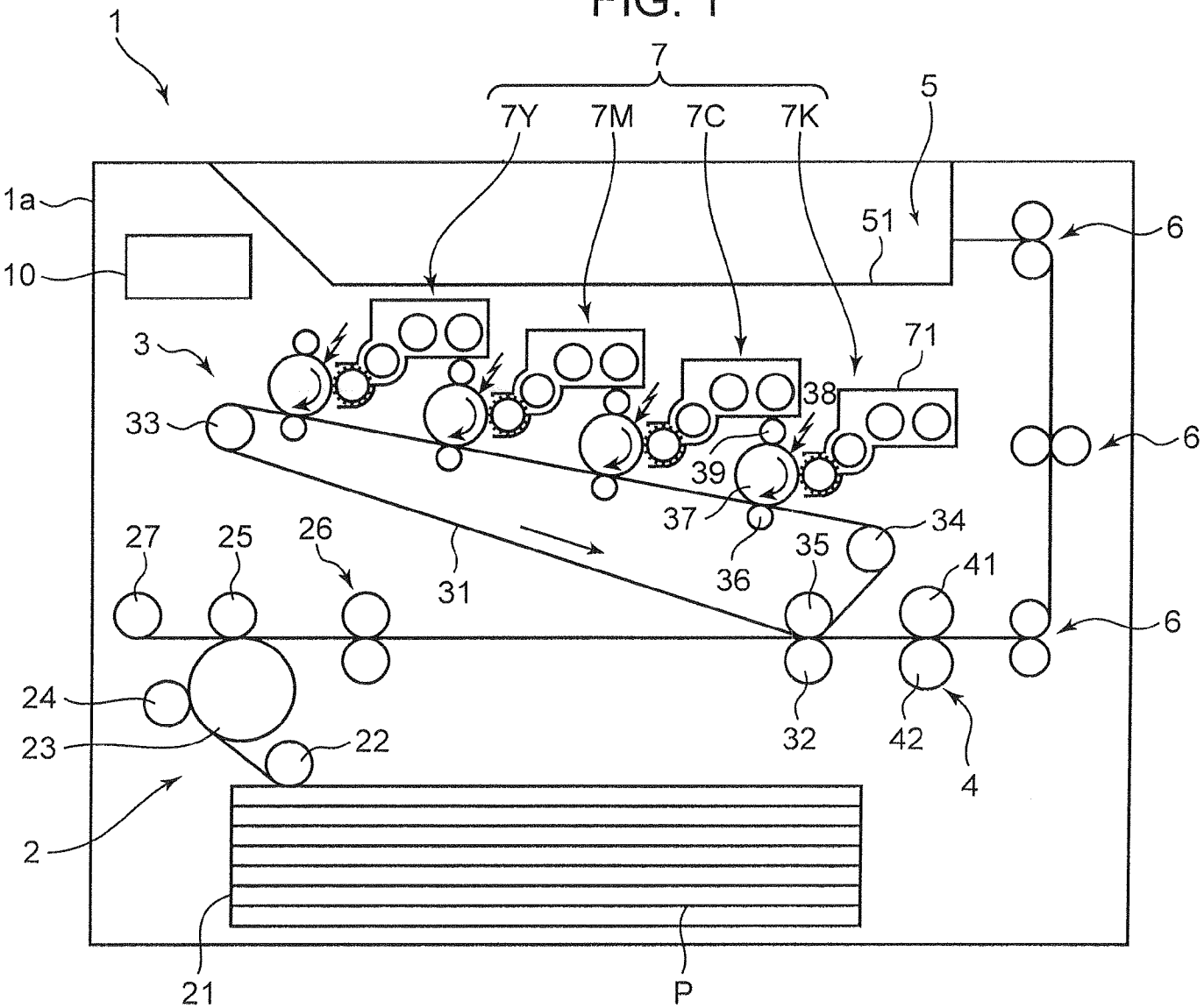
FIG. 1 is a schematic cross section of the printer according to one embodiment of the image forming apparatus comprising the high voltage power supply according to the present disclosure.

Embodiments according to the present disclosure are now explained with reference to the appended drawings. FIG. 1 is a schematic cross section of a printer 1 according to one embodiment of an image forming apparatus comprising the high voltage power supply according to the present disclosure.

As shown in FIG. 1, the printer 1 comprises a box-shaped apparatus body 1*a*. Provided within the apparatus body 1*a* are a paper feeding part 2 for feeding paper P, an image forming part 3, and a fixing part 4. The image forming part 3, while transporting the paper P that was fed from the paper feeding part 2, transfers a toner image based on image data or the like onto the paper P. The fixing part 4 performs fixation treatment of fixing, onto the paper P, the toner image that was transferred onto the paper P by the image forming part 3. Moreover, provided on the upper face of the apparatus body 1*a* is a paper discharge part 5 to which the paper P subject to the fixation treatment by the fixing part 4 is discharged.

The paper feeding part 2 comprises a paper feed cassette 21, a pickup roller 22, paper feed rollers 23, 24, 25, and a resist roller 26. The paper feed cassette 21 stores paper P of various sizes. The paper feed cassette 21 is provided in a manner of being insertable to and removable from the apparatus body 1*a*. The pickup roller 22 is provided at the upper left position shown in FIG. 1 of the paper feed cassette 21, and picks up, one by one, the paper P stored in the paper feed cassette 21. The paper feed rollers 23, 24, 25 deliver the paper P that was picked up by the pickup roller 22 to the paper path. The resist roller 26 causes the paper P that was delivered to the paper path by the paper feed rollers 23, 24, 25 to temporarily stand by, and then supplies the paper P to the image forming part 3 at a predetermined timing.

Moreover, the paper feeding part 2 additionally comprises a manual tray not shown to be mounted on the left side face shown in FIG. 1 of the apparatus body 1*a*, and a pickup roller 27. The pickup roller 27 picks up the paper P mounted on the manual tray. The paper P that was picked up by the pickup roller 27 is delivered to the paper path by the paper feed rollers 23, 25, and supplied to the image forming part 3 by the resist roller 26 at a predetermined timing.

The image forming part 3 comprises an image forming unit 7, an intermediate transfer belt 31, and a secondary transfer roller 32. The image forming unit 7 primarily transfers a toner image based on image data received from an external computer or the like onto a surface (contact surface) of the intermediate transfer belt 31. The secondary transfer roller 32 secondarily transfers the toner image on the intermediate transfer belt 31 onto the paper P that was delivered from the paper feed cassette 21.

The image forming unit 7 comprises a black unit 7K, a cyan unit 7C, a magenta unit 7M, and a yellow unit 7Y. The respective units 7K, 7C, 7M and 7Y are sequentially disposed from the upstream side (right side in FIG. 1) to the downstream side, respectively. The respective units 7K, 7C, 7M and 7Y comprise a photoreceptor drum 37 (image carrier), respectively. Each photoreceptor drum 37 rotates in the arrow direction (clockwise direction) shown in FIG. 1. Around the respective photoreceptor drums 37, from the upstream side to the downstream side in the rotating direction, a charging unit 39, an exposure device 38, a developing device 71, a cleaning device and a static eliminator not shown, and the like are sequentially disposed.

The peripheral surface of the photoreceptor drum 37 is configured, for example, by photosensitive layers made of amorphous silicon being laminated. The peripheral surface of the photoreceptor drum 37 is charged by the charging unit 39. The photoreceptor made of amorphous silicon has properties of increasing the charge density of the surface of the photoreceptor drum 37 during the formation of an electrostatic latent image. It is thereby possible to improve the development performance. Moreover, while the photoreceptor made of amorphous silicon is more expensive than an organic photoreceptor, it is characterized in that the harmless substances are used, handling is easy, and long operating life is yielded.

The charging unit 39 is configured, for example, from a non-contact type discharge corotron and scorotron charging unit, or a contact-type charging roller and charging brush. The exposure device 38 causes the peripheral surface of the photoreceptor drum 37, which was uniformly charged by the charging unit 39, to be irradiated with a laser beam based on image data that was received from an external computer or the like. The exposure device 38 can thereby form an electrostatic latent image based on image data onto the photoreceptor drum 37.

The developing device 71 forms a toner image based on image data onto the peripheral surface of the photoreceptor drum 37 by supplying a toner onto the peripheral surface of the photoreceptor drum 37 onto which the electrostatic latent image was formed. The toner image formed on the peripheral surface of the photoreceptor drum 37 is primarily transferred onto the intermediate transfer belt 31 as described later. The cleaning device cleans the toner remaining on the peripheral surface of the photoreceptor drum 37 after the completion of the primary transfer of the toner image onto the intermediate transfer belt 31. The static eliminator neutralizes the peripheral surface of the photoreceptor drum 37 after the completion of the primary transfer of the toner image onto the intermediate transfer belt 31. The peripheral surface of the photoreceptor drum 37 that was cleaned by the cleaning device and the static eliminator heads toward the charging unit 39 for the subsequent charging treatment.

The intermediate transfer belt 31 is an endless belt-shaped rotating body. The intermediate transfer belt 31 is placed across a plurality of rollers such as a driving roller 33, a driven roller 34, a backup roller 35, and a primary transfer roller 36 so that the surface (contact surface) side comes into contact with the peripheral surface of the respective photoreceptor drums 37. Moreover, the intermediate transfer belt 31 is configured to engage in endless rotation based on a plurality of rollers in a state of being pressed against the photoreceptor drum 37 by the primary transfer roller 36 which is placed opposite to the respective photoreceptor drums 37.

The driving roller 33 is rotatively driven based on the drive force that is applied by a drive source such as a stepping motor, and causes the intermediate transfer belt 31 to engage in endless rotation. The driven roller 34, the backup roller 35, and the primary transfer roller 36 are configured rotatably, and are drivenly rotated pursuant to the endless rotation of the intermediate transfer belt 31 based on the driving roller 33. These rollers 34, 35, 36 are drivenly rotated via the intermediate transfer belt 31 according to the main rotation of the driving roller 33, and support the intermediate transfer belt 31.

The primary transfer roller 36 applies a primary transfer bias (reverse polarity of the charge polarity of the toner) to the intermediate transfer belt 31. Consequently, the toner image formed on the respective photoreceptor drums 37 is sequentially applied, and transferred (primarily transferred), to the intermediate transfer belt 31 rotating in the arrow (counter-clockwise) direction shown in FIG. 1 based on the drive of the driving roller 33 between the respective photoreceptor drums 37 and the primary transfer roller 36.

The secondary transfer roller 32 applies, to the paper P, a secondary transfer bias of a reverse polarity than the toner image. Consequently, the toner image that was primarily transferred onto the intermediate transfer belt 31 is transferred onto the paper P between the secondary transfer roller 32 and the backup roller 35, and a color transfer image is thereby transferred onto the paper P.

The fixing part 4 performs fixation treatment to the transfer image that was transferred onto the paper P at the image forming part 3. The fixing part 4 comprises a heating roller 41 that is heated by a conducting heating element, and a pressure roller 42 that is placed opposite to the heating roller 41 and in which its peripheral surface is pressed against and comes into contact with the peripheral surface of the heating roller 41.

The transfer image that was transferred onto the paper P by the secondary transfer roller 32 at the image forming part 3 is fixed to the paper P based on the fixation treatment of heating the paper P as it passes between the heating roller 41 and the pressure roller 42. The paper P that was subject to the fixation treatment is discharged to the paper discharge part 5 by the transport roller 6. The transport roller 6 is disposed at a suitable location between the fixing part 4 and the paper discharge part 5.

The paper discharge part 5 is formed in the paper receiving tray 51 by the apex of the apparatus body 1*a* of the printer 1 being recessed. The paper receiving tray 51 is formed in a manner of receiving the discharged paper P at the bottom part of the foregoing recessed part.

Moreover, a control unit 10 is provided within the apparatus body 1*a*. The control unit 10 is configured, for example, from a microcomputer comprising a central processing unit (CPU), a read only memory (ROM) for storing programs, a random access memory (RAM) for temporarily storing data upon executing the various types of processing, an I/O interface circuit, and a bus for connecting the foregoing components. The control unit 10 controls the operation of the respective components in the apparatus by causing the CPU to execute the programs stored in the ROM and the like.

Figure 2:
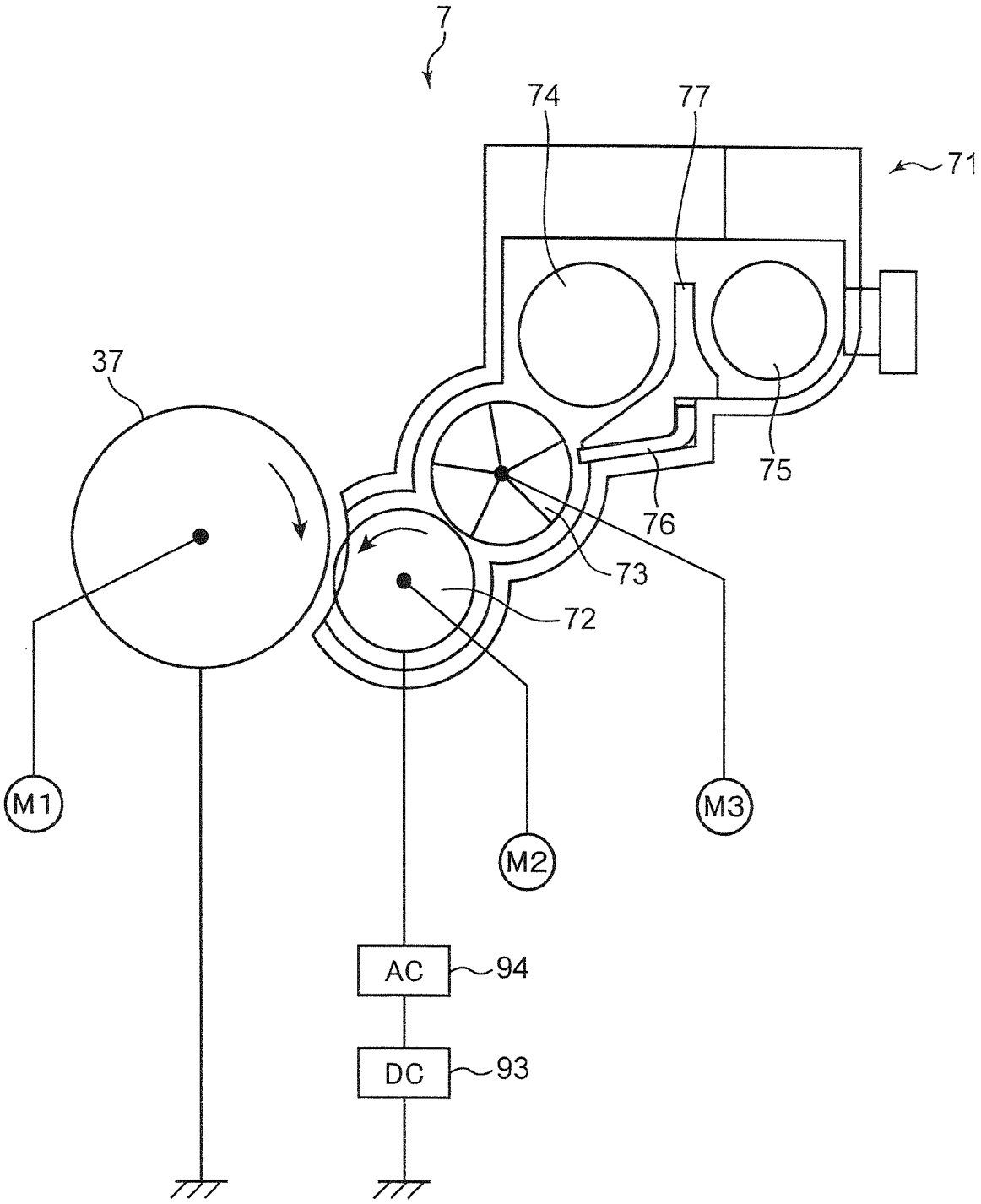
FIG. 2 is a cross section showing a schematic configuration of the developing device.

The configuration of the developing device 71 is now explained. FIG. 2 is a cross section showing the schematic configuration of the developing device 71. Note that the developing devices 71 provided respectively to the image forming units 7K, 7C, 7M and 7Y are all configured in the same manner.

The developing device 71 comprises a developing roller (developer carrier), a magnetic roller 73, a paddle mixer 74, an agitation mixer 75, an ear-breaking blade 76, a partition plate 77, a DC power supply part 93, and an AC power supply part 94. The photoreceptor drum 37 is driven by a drum motor M1, and the developing roller 72 is driven by a developing motor M2. In other words, the photoreceptor drum 37 and the developing roller 72 are driven independently.

The developing roller 72 supplies a toner onto the peripheral surface of the photoreceptor drum 37 by carrying and delivering the toner (developer) onto the peripheral surface. Consequently, the electrostatic latent image that was formed on the peripheral surface of the photoreceptor drum 37 in advance becomes visualized (developed) as a toner image. Moreover, the developing roller 72 has a magnet build therein so that the magnetic pole is formed at a position which faces the magnetic roller 73. The magnetic roller 73 forms a magnetic brush with the magnet disposed internally, and supplies the toner onto the developing roller 72.

The paddle mixer 74 and the agitation mixer 75 possess helical blades, and charge the toner by agitating the toner, while delivering the toner, in mutually different directions. In addition, the paddle mixer 74 supplies the charged toner onto the magnetic roller 73. The ear-breaking blade 76 regulates the thickness of the magnetic brush formed on the magnetic roller 73. The partition plate 77 is provided between the paddle mixer 74 and the agitation mixer 75, and can allow the toner to freely pass through at sides which are more outward than the either side of the partition plate 77.

The toner that was charged by the paddle mixer 74 and the agitation mixer 75 is supplied to the magnetic roller 73. The toner supplied to the magnetic roller 73 is delivered as a magnetic brush based on the magnet inside the magnetic roller 73. Subsequently, the magnetic brush moves based on the rotation of the sleeve of the surface of the magnetic roller 73, and the thickness thereof is regulated upon passing between the ear-breaking blade 76 and the magnetic roller 73.

The DC power supply part 93 applies a direct voltage to the developing roller 72. The AC power supply part 94 applies an alternating voltage to the developing roller 72. A developing bias voltage, which is a voltage obtained by the direct voltage output from the DC power supply part 93 and the alternating voltage output from the AC power supply part 94 being superimposed, is applied to the developing roller 72, and a potential difference is thereby generated between the photoreceptor drum 37 and the developing roller 72. Based on this potential difference, the toner carried onto the peripheral surface of the developing roller 72 is supplied to the photoreceptor drum 37, and the development of the electrostatic latent image formed on the photoreceptor drum 37 is thereby performed.

Figure 3:
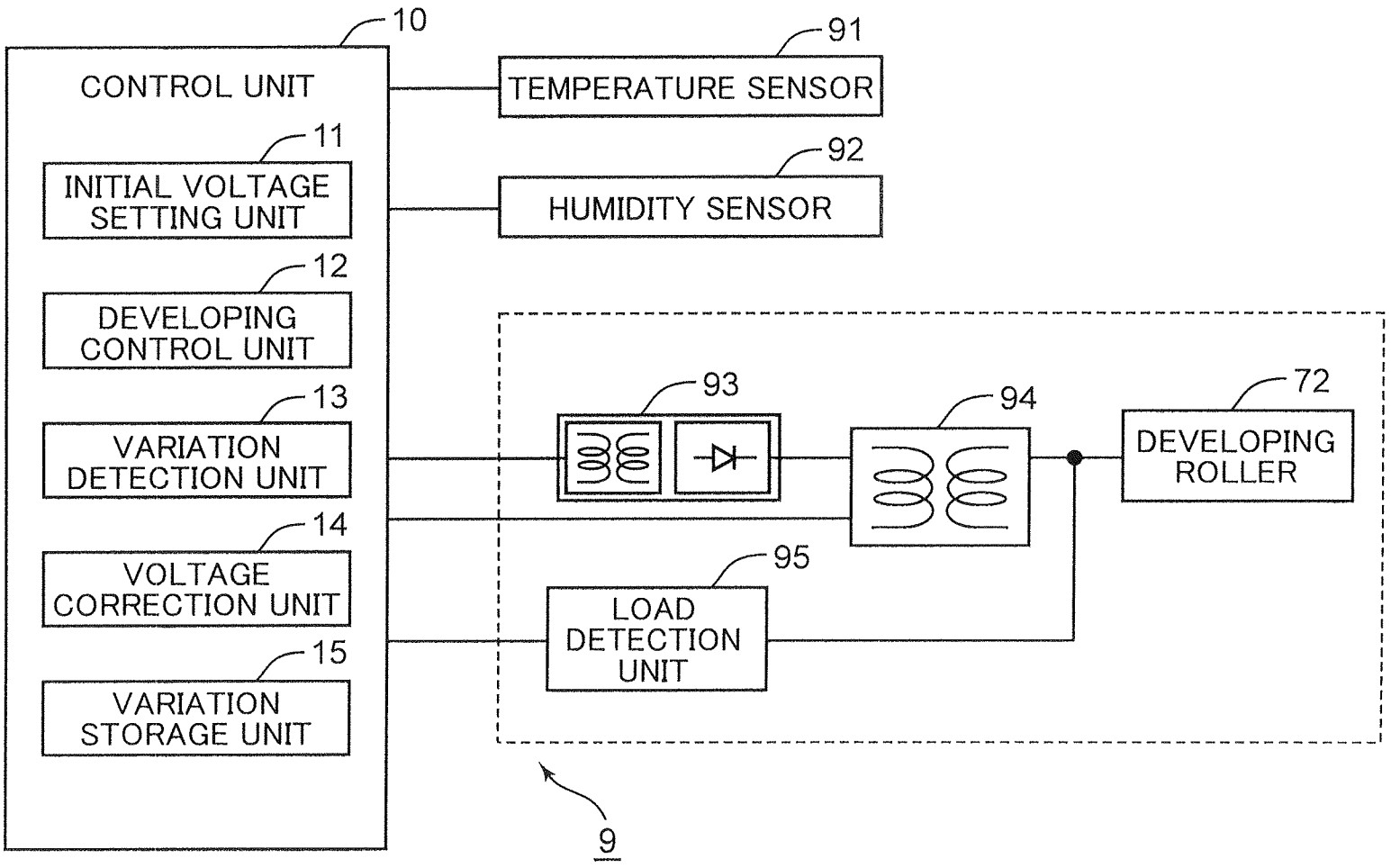
FIG. 3 is a block diagram showing the electrical configuration of the high voltage power supply.

The operation of the output control of the developing bias voltage by the high voltage power supply 9 is now explained. FIG. 3 is a block diagram showing the electrical configuration of the high voltage power supply 9.

As shown in FIG. 3, the high voltage power supply 9 comprises a temperature sensor (temperature detection unit) 91, a humidity sensor (humidity detection unit) 92, a DC power supply part 93, an AC power supply part 94, and a control unit 10.

The temperature sensor 91 detects the temperature near the developing roller 72. The temperature sensor 91 is provided, for example, within a predetermined close distance from the image forming part 3. In other words, the temperature sensor 91 detects the temperature near the developing roller 72 to receive the output of the developing bias voltage from the high voltage power supply 9, and outputs a detection signal indicating the detected temperature to the control unit 10.

The humidity sensor 92 detects the humidity near the developing roller 72. The humidity sensor 92 is provided, for example, within a predetermined close distance from the image forming part 3. In other words, the humidity sensor 92 detects the humidity near the developing roller 72 to receive the output of the developing bias voltage from the high voltage power supply 9, and outputs a detection signal indicating the detected humidity to the control unit 10.

A control signal output from the developing control unit 12 described later is input to the DC power supply part 93. The DC power supply part 93 converts the alternative voltage supplied to an AC power supply such as a commercial power supply into a direct voltage of a predetermined voltage value based on an AC/DC converter not shown, and thereafter converts the direct voltage into an alternating voltage based on a DC/AC converter not shown. In addition, the DC power supply part 93 rectifies the converted alternating voltage with a rectifier circuit, and outputs a direct voltage of a voltage value indicated by the input control signal. Note that the method of the DC power supply part 93 outputting a direct voltage of a voltage value indicated by the input control signal is not limited to the foregoing method.

A control signal output from the developing control unit 12 described later is input to the AC power supply part 94. The AC power supply part 94 converts the alternative voltage supplied to an AC power supply such as a commercial power supply into a direct voltage of a predetermined voltage value based on an AC/DC converter not shown, and thereafter converts the direct voltage into a peak voltage or the alternating voltage of a predetermined setting value, such as the duty ratio, indicated by the input control signal based on a DC/AC converter not shown, and outputs the foregoing peak voltage or the alternating voltage. Consequently, a voltage obtained by superimposing the alternating voltage output from the AC power supply part 94 and the direct voltage output from the DC power supply part 93 is applied, as a developing bias voltage, to the developing roller 72. Note that the method of the AC power supply part 94 outputting a peak voltage or the alternating voltage of a predetermined setting value, such as the duty ratio, indicated by the input control signal is not limited to the foregoing method.

The load detection unit 95 detects the capacitance C1 between the developing roller 72 and the photoreceptor drum 37, and outputs a detection signal indicating the detected capacitance C1 to the variation detection unit 13. For example, the load detection unit 95 measures the current value of the current that is output from the AC power supply part 94 to the developing roller 72, and calculates the capacitance C1 between the developing roller 72 and the photoreceptor drum 37 by using the measured current value and the alternating voltage that is applied to the developing roller 72 based on the AC power supply part 94. For example, the load detection unit 95 calculates the capacitance C1 from the detection value of the alternating current based on the fact that the current value of the alternating current that flows based on the application of the alternating voltage becomes greater as the capacitance is greater. However, the method of the load detection unit 95 detecting the capacitance between the developing roller 72 and the photoreceptor drum 37 is not limited to the foregoing method.

Note that the DC power supply part 93, the AC power supply part 94, the load detection unit 95, and the developing roller 72 shown within the rectangle indicated with a broken line in FIG. 3 are respectively provided to the black unit 7K, the cyan unit 7C, the magenta unit 7M, and the yellow unit 7Y, and all have the same configuration.

In relation to the control of the developing bias voltage, the control unit 10 particularly functions as an initial voltage setting unit 11, a developing control unit 12, a voltage correction unit 14, a variation detection unit 13 and a variation storage unit 15.

The initial voltage setting unit 11 uses the temperature detected by the temperature sensor 91 and the humidity detected by the humidity sensor 92 to set the initial value of the direct voltage to be output to the DC power supply part 93 and the alternating voltage to be output to the AC power supply part 94 with the developing control unit 12 described later based on the charging characteristics of the toner of the respective colors according to the detected temperature and humidity.

Specifically, information which associates the combination of the temperature and humidity, and the charging characteristics of the toner of the respective colors in the temperature and humidity of the foregoing combination is predetermined based on an experimental value obtained from test operation or the like, and stored in the ROM or the like. Moreover, information which associates the charging characteristics of the toner of the respective colors, the voltage value of the direct voltage to be supplied to the developing roller 72, the peak voltage of the alternating voltage, and the duty ratio of the alternating voltage which are required for moving the toner of the respective colors of the foregoing charging characteristics from the developing roller 72 to the photoreceptor drum 37 is predetermined based on an experimental value obtained from test operation or the like, and stored in the ROM or the like.

Figure 4:
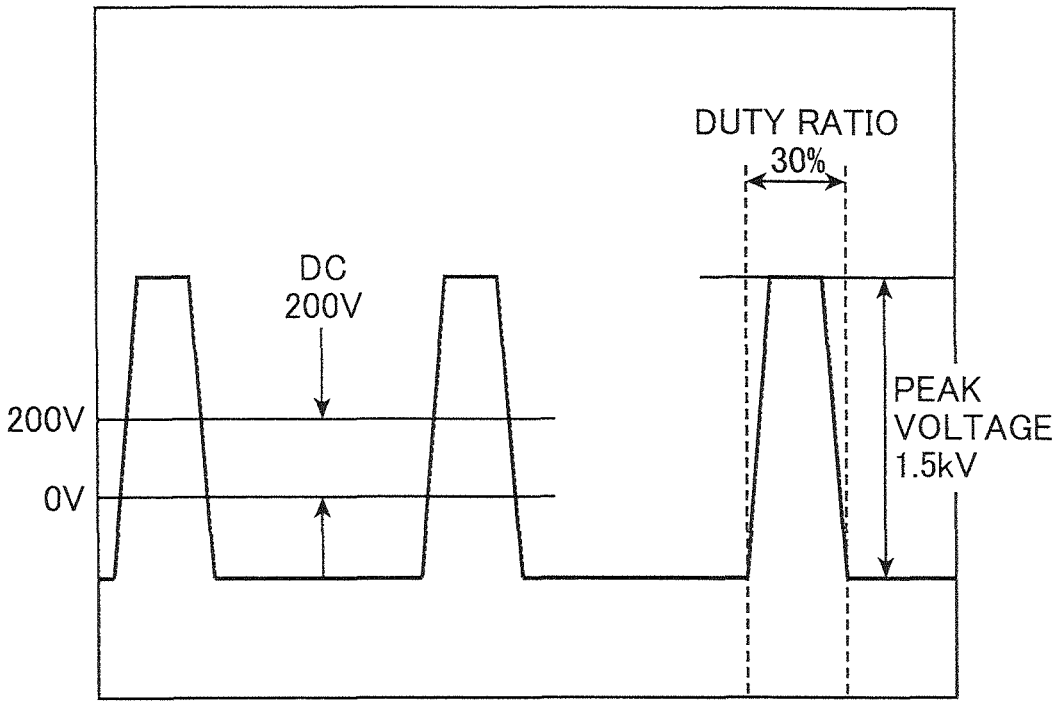
FIG. 4 is an explanatory diagram showing an example of the waveform of the developing bias voltage that is output from the high voltage power supply.

FIG. 4 is an explanatory diagram showing an example of the waveform of the developing bias voltage that is output from the high voltage power supply 9. The initial voltage setting unit 11 uses the information stored in the ROM or the like at a predetermined timing and acquires the charging characteristics of the toner of the respective colors corresponding to the combination of the temperature detected by the temperature sensor 91 and the humidity detected by the humidity sensor 92. A predetermined timing is, for instance, when the AC power supply such as a commercial power supply is turned on, each time the temperature detected by the temperature sensor 91 changes by at least a predetermined temperature from the time that the AC power supply is turned on, or each time the humidity detected by the humidity sensor 92 changes by at least a predetermined humidity from the time that the AC power supply is turned on. In addition, the initial voltage setting unit 11 uses the foregoing information stored in the ROM or the like and, for example, as shown in FIG. 4, acquires the voltage value 200 V of the direct voltage, the peak voltage 1.5 kV of the alternating voltage, and the duty ratio 30% of the alternative voltage associated with the acquired charging characteristics of the toner of the respective colors, and sets each of the acquired values as the initial value of the developing bias voltage. Note that the settings of the alternating voltage are not limited to the foregoing peak voltage and duty ratio, and may also be the amplitude, effective value, frequency, and the like. The value that is set to the settings of the alternating voltage is indicating as the setting value in the ensuing explanation.

The developing control unit 12 causes the DC power supply part 93 to apply, to the developing roller 72, the direct voltage of a predetermined voltage value that is set by the initial voltage setting unit 11 or the voltage correction unit 14 described later, and causes the AC power supply part 94 to apply, to the developing roller 72, the alternating voltage of a predetermined setting value that is set by the initial voltage setting unit 11 or the voltage correction unit 14 described later. Consequently, the developing control unit 12 generates a potential difference between the photoreceptor drum 37 and the developing roller 72, and thereby develops an electrostatic latent image by supplying the toner from the developing roller 72 to the photoreceptor drum 37 based on the foregoing potential difference.

The variation detection unit 13 detects the variation in the capacitance C1 between the developing roller 72 and the photoreceptor drum 37 detected by the load detection unit 95. For instance, when the developing bias voltage of an initial value that is set by the initial voltage setting unit 11 is applied to the developing roller 72 based on an experimental value obtained from a test operation or the like, the information indicating the capacitance between the photoreceptor drum 37 and the developing roller 72 detected by the load detection unit 95 is predetermined, and stored in the ROM. The variation detection unit 13 acquires from the ROM the information indicating the capacitance between the photoreceptor drum 37 and the developing roller 72 detected by the load detection unit 95 when the developing bias voltage of an initial value that is set by the initial voltage setting unit 11 is applied to the developing roller 72, and sets this as reference capacitance C0. In addition, the variation detection unit 13 detects the amount that the capacitance C1 detected by the load detection unit 95 changed from the reference capacitance C0.

As the variation detected by the variation detection unit 13 increases, the voltage correction unit 14 decreases the developing bias voltage by decreasing either the direct voltage output by the DC power supply part 93 or the alternating voltage output by the AC power supply part 94 according to the increased variation. Moreover, as the variation detected by the variation detection unit 13 decreases, the voltage correction unit 14 increases the developing bias voltage by increasing at least either of the above according to the decreased variation. The voltage correction unit 14 thereby executes the correction processing of correcting at least either the direct voltage output by the DC power supply part 93 or the alternating voltage output by the AC power supply part 94.

The variation storage unit 15 is configured, for example, from a storage medium such as a ROM. In the variation storage unit 15, the variation in the capacitance between the photoreceptor drum 37 and the developing roller 72 and the amount of the developing bias voltage to be applied to the developing roller 72, which is to be increased or decreased according to the foregoing variation is associated based on an experimental value obtained from a test operation or the like, and stored.

For example, stored in the variation storage unit 15 is information that the direct voltage to be applied to the developing roller 72 is to be decreased by 20 V in association with the capacitance increasing by 10 pF since the distance between the photoreceptor drum 37 and the developing roller 72 has narrowed pursuant to the foregoing increase. Moreover, contrary to the above, stored in the variation storage unit 15 is information that the direct voltage to be applied to the developing roller 72 is to be increased by 20 V in association with the capacitance decreasing by 10 pF since the distance between the photoreceptor drum 37 and the developing roller 72 has spread pursuant to the foregoing decrease.

Note that the variation storage unit 15 may store, in addition to the foregoing information of increasing or decreasing the direct voltage in association with the variation in the capacitance, information of increasing or decreasing the alternating voltage in association with the variation in the capacitance. Otherwise, the variation storage unit 15 may also store only the information of increasing or decreasing the alternating voltage in association with the variation in the capacitance, without storing the foregoing information of increasing or decreasing the direct voltage in association with the variation in the capacitance.

In other words, the variation storage unit 15 stores the variation in the capacitance between the photoreceptor drum 37 and the developing roller 72, and the amount to be increased or decreased of at least either the direct voltage or the alternating voltage contained in the developing bias voltage to be applied to the developing roller 72 according to the variation, by associating the variation with the amount. The voltage correction unit 14 corrects at least either the direct voltage or the alternating voltage by using the information stored in the variation storage unit 15 by using the foregoing correction processing.

Figure 5:
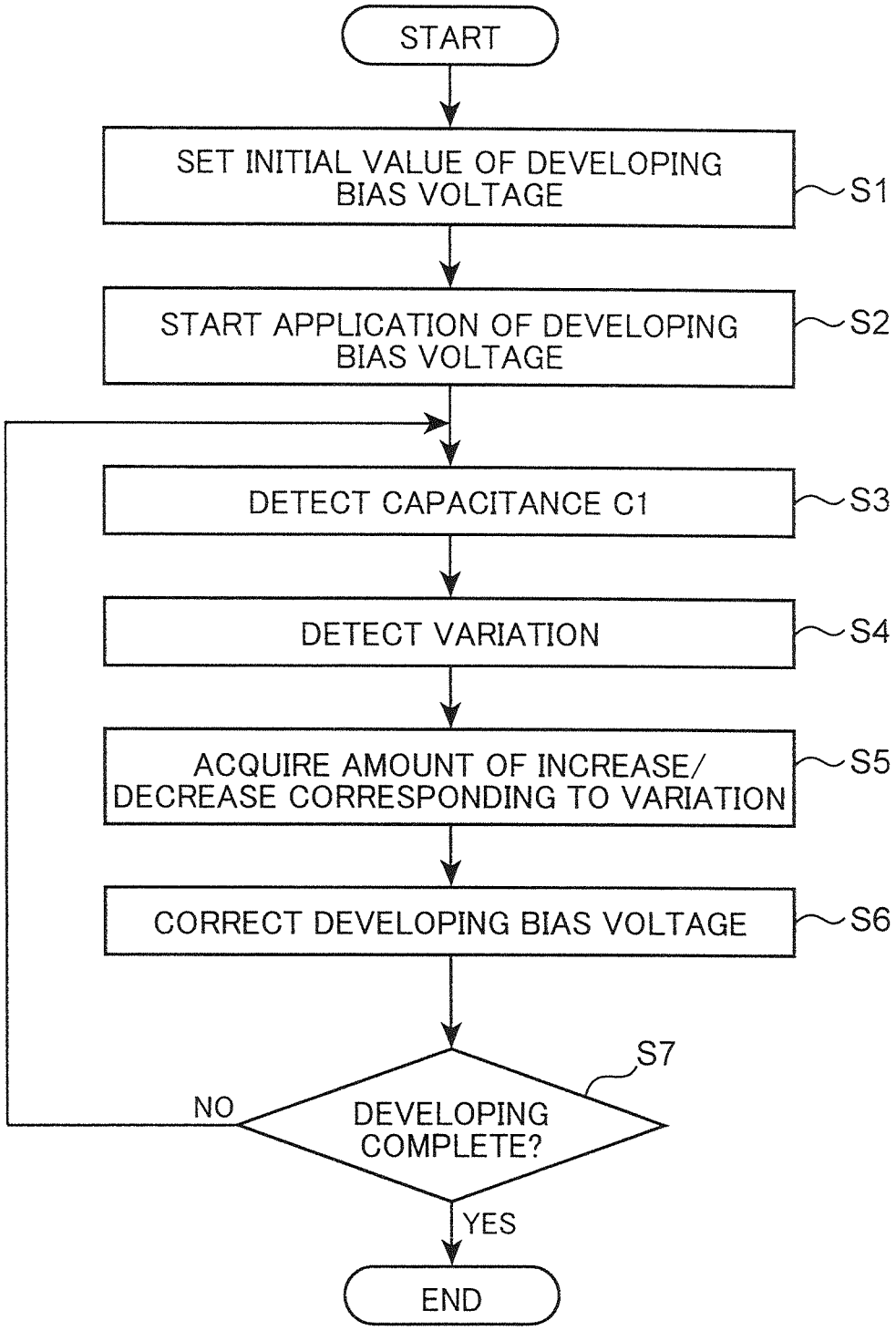
FIG. 5 is a flowchart showing the operation of the correction processing of correcting the developing bias voltage.

The correction processing for correcting the developing bias voltage is now explained with reference to FIG. 5. FIG. 5 is a flowchart showing the operation of the correction processing of correcting the developing bias voltage.

The initial voltage setting unit 11 acquires, at a predetermined timing, the charging characteristics of the toner of the respective colors corresponding to the combination of the temperature detected by the temperature sensor 91 and the humidity detected by the humidity sensor 92 based on the information stored in a ROM or the like. A predetermined timing is, for instance, when the AC power supply such as a commercial power supply is turned on, each time the temperature detected by the temperature sensor 91 changes by at least a predetermined temperature from the time that the AC power supply is turned on, or each time the humidity detected by the humidity sensor 92 changes by at least a predetermined humidity from the time that the AC power supply is turned on. Subsequently, the initial voltage setting unit 11 uses the information stored in the ROM or the like and acquires information for associating the voltage value of the direct voltage to be supplied to the developing roller 72 and the respective setting values of the alternating voltage which is required for moving the toner of the respective colors of the acquired charging characteristics from the developing roller 72 to the photoreceptor drum 37. In addition, the initial voltage setting unit 11 sets each of the acquired values as the initial value of the direct voltage and the alternating voltage configuring the developing bias voltage (S1).

When the operation for forming an image with the image forming unit 7 is started as a result of the control unit 10 receiving, together with the image data from an external computer or the like, a control signal indicating a command for printing and outputting the image data, the developing control unit 12 starts, in step S1, the application of the developing bias voltage, which is obtained by superimposing the direct voltage and the alternating voltage having the initial values that were set by the initial voltage setting unit 11, onto the developing roller 72 (S2).

When the application of the developing bias voltage onto the developing roller 72 is started, the load detection unit 95 detects the capacitance C1 between the developing roller 72 and the photoreceptor drum 37, and outputs the detection signal indicating the detected capacitance C1 to the variation detection unit 13 (S3). The variation detection unit 13 uses the information pre-stored in a ROM based on an experimental value obtained from a test operation or the like, and sets the capacitance between the photoreceptor drum 37 and the developing roller 72 detected by the load detection unit 95 upon the developing bias voltage, which is obtained by superimposing the direct voltage and the alternating voltage having the initial values that were set in step S1, being applied to the developing roller 72 as the reference capacitance C0. Subsequently, the variation detection unit 13 detects the variation indicating to what extent the capacitance C1 indicated by the detection signal input in step S3 has changed from the reference capacitance C0 (S4).

The voltage correction unit 14 acquires, from the variation storage unit 15, the amount of increase/decrease of at least either the direct voltage or the alternating voltage corresponding to the variation detected in step S4 (S5). In addition, the voltage correction unit 14 performs the correction processing of correcting at least either the direct voltage or the alternating voltage by using the acquired amount of increase/decrease. The developing control unit 12 outputs, to the DC power supply part 93 and the AC power supply part 94, the control signals indicating the voltage value of the direct voltage and the respective setting values of the alternating voltage after the performance of the correction processing, respectively. The corrected developing bias voltage is thereby applied to the developing roller 72 (S6).

For example, in step S1, let it be assumed that the initial voltage setting unit 11 set the initial value of the direct voltage to 200 V, and the initial value of the peak voltage of the alternating voltage to 1.5 kV. In addition, let it be assumed that the capacitance that is detected by the load detection unit 95 when the developing bias voltage obtained by superimposing the direct voltage and the alternating voltage of the foregoing initial values is applied to the developing roller 72 is set forth a 70 pF based on an experimental value obtained from a test operation or the like, and stored in a ROM. In the foregoing case, for instance, when the capacitance C1 between the photoreceptor drum 37 and the developing roller 72 that was detected by the load detection unit 95 in step S3 is 80 pF, in step S4, the variation detection unit 13 detects that the capacitance C1 has increased by 10 pF from the reference capacitance C0 of 70 pF.

In addition, on the assumption that only information of decreasing the direct voltage by 20 V is stored in the variation storage unit 15 in association with the capacitance C1 increasing by 10 pF, in step S6, the voltage correction unit 14 corrects the voltage value of the direct voltage to 180 V, which is 20 V less than the initial value of 200 V. In addition, the developing control unit 12 outputs, to the DC power supply part 93, a control signal indicating the voltage value of the direct voltage after the correction processing is 180 V, and outputs, to the AC power supply part 94, a control signal indicating 1.5 kV as the peak voltage of the alternating voltage of the initial value that has not been corrected based on the correction processing. Consequently, a direct voltage of 180 V is output from the DC power supply part 93, and an alternating voltage having a peak voltage of 1.5 kV is output from the AC power supply part 94. Consequently, a corrected developing bias voltage obtained by superimposing the foregoing direct voltage and the alternating voltage is applied to the developing roller 72.

After the execution of step S6, during the period that the operation of development that was started as a result of the application of the developing bias voltage being started in step S2 is not complete (S7; NO), the developing control unit 12 repeats the processing of step S3 onward. Subsequently, when the operation of development that was started as a result of the application of the developing bias voltage being started in step S2 is completed (S7; YES), the voltage correction unit 14 ends the correction processing of correcting the developing bias voltage.

In the foregoing embodiment, the variation detection unit 13 is detecting the variation in the capacitance by setting off the capacitance that changes based on the environmental conditions at the starting point of such change contained in the capacitance that is detected by the load detection unit 95, and the capacitance that changes based on the environmental conditions at the end point of such change contained in the capacitance that is detected by the load detection unit 95. In other words, the variation in the capacitance detected by the variation detection unit 13 indicates the variation in the capacitance that changed due to the change in the distance between the developing roller 72 and the photoreceptor drum 37.

Thus, according to the foregoing embodiment, the voltage correction unit 14 can appropriately decrease the developing bias voltage on the assumption that, as the variation in the capacitance detected by the variation detection unit 13 increases, the gap between the developing roller 72 and the photoreceptor drum 37 has narrowed and the supply of toner to the photoreceptor drum 37 has been facilitated in accordance with the increased variation. Contrarily, the voltage correction unit 14 can appropriately increase the developing bias voltage on the assumption that, as the variation in the capacitance detected by the variation detection unit 13 decreases, the gap between the developing roller 72 and the photoreceptor drum 37 has spread and the supply of toner to the photoreceptor drum 37 has become difficult in accordance with the decreased variation.

As described above, according to the foregoing embodiment, the developing bias voltage can be appropriately corrected by appropriately reflecting the influence caused by the change in the distance between the developing roller 72 and the photoreceptor drum 37 in comparison to the case of correcting the developing bias voltage to become a proper value corresponding to the absolute value of the magnitude of capacitance while including the capacitance which changes due to environmental conditions. Consequently, an appropriate amount of toner can be supplied to the photoreceptor drum 37, and deterioration in the image quality of toner images formed on the photoreceptor drum 37 can be reduced.

Moreover, according to the foregoing embodiment, the developing bias voltage can be easily corrected based on the variation of capacitance and the amount of the developing bias voltage to be increased or decreased according to that variation stored in the variation storage unit 15.

When developing bias voltages of the same voltage value are applied together with developers having different charging characteristics, the travel distance of the developer will differ according to the respective charging characteristics. According to the foregoing embodiment, the initial value of the developing bias voltage capable of moving the toner an appropriate distance can be set by the initial voltage setting unit 11 upon giving consideration to the charging characteristics of the toner according to the temperature detected by the temperature sensor 91 and the humidity detected by the humidity sensor 92. In addition, the voltage correction unit 14 can more appropriately correct the developing bias voltage value by performing the correction processing of correcting the developing bias voltage after setting the appropriate initial value according to the environmental conditions as described above.

Moreover, with the capacitance detected by the load detection unit 95 upon the initial value of the developing bias voltage being set by the initial voltage setting unit 11 as the reference capacitance C0, the variation detection unit 13 can detect the amount that the capacitance C1 detected by the load detection unit 95 has changed from the reference capacitance C0.

Thus, it could be said that the variation in the capacitance detected by the variation detection unit 13 indicates the variation when the developing bias voltage having the initial value set by the initial voltage setting unit 11 changed under the same environment when it was output. Accordingly, the voltage correction unit 14 can appropriately correct the developing bias voltage under the foregoing environment by using the variation in the capacitance.

Moreover, according to the foregoing embodiment, the initial voltage setting unit 11 sets the initial value of the developing bias voltage when the AC power supply such as a commercial power supply is turned on. Thus, the initial value of the developing bias voltage can be appropriately set when the power source for supplying the direct voltage and the alternating voltage configuring the developing bias voltage is turned on; that is, at the point in time that the control of detecting some kind of environmental condition is enabled as a result of the power source being turned on.

Moreover, according to the configuration of the foregoing embodiment, the initial voltage setting unit 11 sets the initial value of the developing bias voltage when the temperature detected by the temperature sensor 91 changes by at least a predetermined temperature, or when the humidity detected by the humidity sensor 92 changes by at least a predetermined humidity. Thus, the initial value of the developing bias voltage can be appropriately changed at a timing in which the charging characteristics of the toner are different and the initial value of the developing bias voltage needs to be changed as a result of the temperature near the developing roller 72 changing by at least a predetermined temperature or the humidity near the developing roller 72 changing by at least a predetermined humidity.

Note that the present disclosure is not limited to the configuration of the embodiment and may be variously modified. For example, the initial voltage setting unit 11 may set, each time the operation of development by the developing control unit 12 is started, set the initial value of the developing bias voltage at such starting time.

Moreover, the variation storage unit 15 may be omitted. Consequently, the voltage correction unit 14 may increase or decrease the developing bias voltage by using the output value obtained when the variation detected by the variation detection unit 13 is input as a predetermined function indicating the correlation of the variation detected by the variation detection unit 13 and the corrected developing bias voltage such as by linearly increasing or decreasing the developing bias voltage as a result of multiplying the variation detected by the variation detection unit 13 by a predetermined constant.

Otherwise, the temperature sensor 91, the humidity sensor 92, and the initial voltage setting unit 11 may be omitted, and the initial value of the voltage value of the direct voltage that is output by the DC power supply part 93 and the initial value of the respective setting values of the alternative voltage that is output by the AC power supply part 94 may be set as fixed values.

Moreover, the control unit 10 is not limited to the configuration of controlling the operation of the respective components in the apparatus by causing the CPU to execute the programs stored in a ROM or the like and, for example, may also be configured to control the operation of the respective components in the apparatus by using dedicated hardware such as application specific integrated circuits (ASIC) or an analog circuit.

Moreover, the foregoing embodiment explained a case taking a color printer as an example of the image forming apparatus according to the present disclosure. The present disclosure can also be applied to a black-and-white printer, a facsimile machine, a copier, and a multifunction printer.

As explained above, according to the present disclosure, it is possible to appropriately correct the developing bias voltage for reducing the deterioration in the image quality of toner images formed on the photoreceptor.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A high voltage power supply, comprising:

a developer carrier for carrying a developer on a peripheral surface thereof;

an image carrier for carrying an electrostatic latent image on a peripheral surface thereof;

a temperature detection unit for detecting a temperature near the developer carrier;

a humidity detection unit for detecting a humidity near the developer carrier;

a DC power supply part for outputting a direct voltage of a voltage value indicated by a first control signal inputted;

an AC power supply part for outputting an alternating voltage of a setting value indicated by a second control signal inputted;

a developing control unit for applying a developing bias voltage, which is obtained by superimposing the direct voltage that is outputted from the DC power supply part by outputting the first voltage control signal to the DC power supply part and the alternating voltage that is outputted from the AC power supply part by outputting the second control signal to the AC power supply part, to the developer carrier and generating a potential difference between the developer carrier and the image carrier, and thereby supplying the developer to the image carrier and developing the electrostatic latent image;

an initial voltage setting unit for setting initial values of the voltage value and the setting value based on charging characteristics of the developer according to the temperature detected by the temperature detection unit and the humidity detected by the humidity detection unit;

a load detection unit for detecting capacitance between the developer carrier and the image carrier;

a variation detection unit for setting the capacitance detected by the load detection unit when the initial values were set by the initial voltage setting unit as a reference capacitance, and detecting a variation indicating to what extent the capacitance detected by the load detection unit has changed from the reference capacitance whenever the capacitance is detected by the load detection unit; and a voltage correction unit for executing correction processing of correcting the developing bias voltage by decreasing the voltage value as the variation increases, and increasing the voltage value as the variation decreases whenever the variation is detected by the variation detection unit during a period from the start to the end of an operation of developing the electrostatic latent image by the developing control unit after the initial values were set by the initial voltage setting unit.

2. The high voltage power supply according to claim 1, further comprising:

a variation storage unit for storing the variation and an amount of the voltage value to be increased or decreased according to the variation, by associating the variation therewith.

3. The high voltage power supply according to claim 1, wherein the initial voltage setting unit sets the initial values when a power source for supplying a voltage to the DC power supply part and the AC power supply part is turned on.

4. The high voltage power supply according to claim 1, wherein the initial voltage setting unit sets the initial value when the temperature near the developer carrier detected by the temperature detection unit changes by at least a predetermined temperature.

5. The high voltage power supply according to claim 1, wherein the initial voltage setting unit sets the initial value when the humidity near the developer carrier detected by the humidity detection unit changes by at least a predetermined humidity.

6. An image forming apparatus, comprising:

the high voltage power supply according to claim 1; and an image forming part for forming an image on paper using the electrostatic latent image to be developed by the developing control unit of the high voltage power supply.

7. The image forming apparatus according to claim 6, further comprising:

a variation storage unit for storing the variation and an amount of the voltage value to be increased or decreased according to the variation, by associating the variation therewith.

8. The image forming apparatus according to claim 6, wherein the initial voltage setting unit sets the initial values when a power source for supplying a voltage to the DC power supply part and the AC power supply part is turned on.

9. The image forming apparatus according to claim 6, wherein the initial voltage setting unit sets the initial value when the temperature near the developer carrier detected by the temperature detection unit changes by at least a predetermined temperature.

10. The image forming apparatus according to claim 6, wherein the initial voltage setting unit sets the initial value when the humidity near the developer carrier detected by the humidity detection unit changes by at least a predetermined humidity.

* * * * *